US005335953A

United States Patent [19]

Luther, Sr.

[11] Patent Number: 5,335,953

[45] Date of Patent: Aug. 9, 1994

[54] GOLF BALL RETRIEVER AND DISPENSER

[76] Inventor: Walter C. Luther, Sr., Rte. 4, Box 453, Lake City, Fla. 32059

[21] Appl. No.: 993,627

[22] Filed: Dec. 21, 1992

[51] Int. Cl.[5] ..... A63B 47/02

[52] U.S. Cl. ..... 294/19.2; 294/99.1

[58] Field of Search ..... 294/19.1, 19.2, 99.1; 273/32 D, 32 F, 32.5, 162 E, 201

[56] References Cited

U.S. PATENT DOCUMENTS

| | | | |
|---|---|---|---|
| 2,609,198 | 9/1952 | Armstrong | 273/32.5 |
| 3,904,200 | 9/1975 | Jackle et al. | 294/19.2 X |
| 3,957,297 | 5/1976 | Hanks | 294/19.2 |
| 4,021,068 | 5/1977 | Piazza | 294/19.2 |
| 4,466,650 | 8/1984 | Roedel | 294/19.2 |
| 4,616,826 | 10/1986 | Trefts | 294/19.2 X |
| 4,676,397 | 6/1987 | Hoffmeister | 273/201 X |
| 4,969,646 | 11/1990 | Tobias | 294/19.2 X |
| 5,037,150 | 8/1991 | Vecchi | 294/19.2 |
| 5,080,357 | 1/1992 | Wolf | 294/19.2 X |
| 5,165,744 | 11/1992 | Vogrin | 294/19.2 |

*Primary Examiner*—Dean J. Kramer
*Attorney, Agent, or Firm*—Arthur G. Yeager

[57] ABSTRACT

An apparatus for picking up one golf ball and placing it on a tee includes two telescoping tubular members, and spring biased fingers at the lower end to grip a golf ball. The inner tubular member is movable outwardly to push the golf ball out of the grip of the fingers, and a spring biased inner tubular member is in retracted position further inside the outer tubular member until ready to dispense the golf ball from the grip of the fingers. A pair of removable legs engage the outer tubular member to allow the apparatus to stand generally upright. Another embodiment employs a resilient cup member in lieu of the spring biased fingers at the lower end, such cup member frictionally gripping a golf ball and releasing same by a selective dispensing force exerted on the golf ball by the inner tubular member.

16 Claims, 4 Drawing Sheets

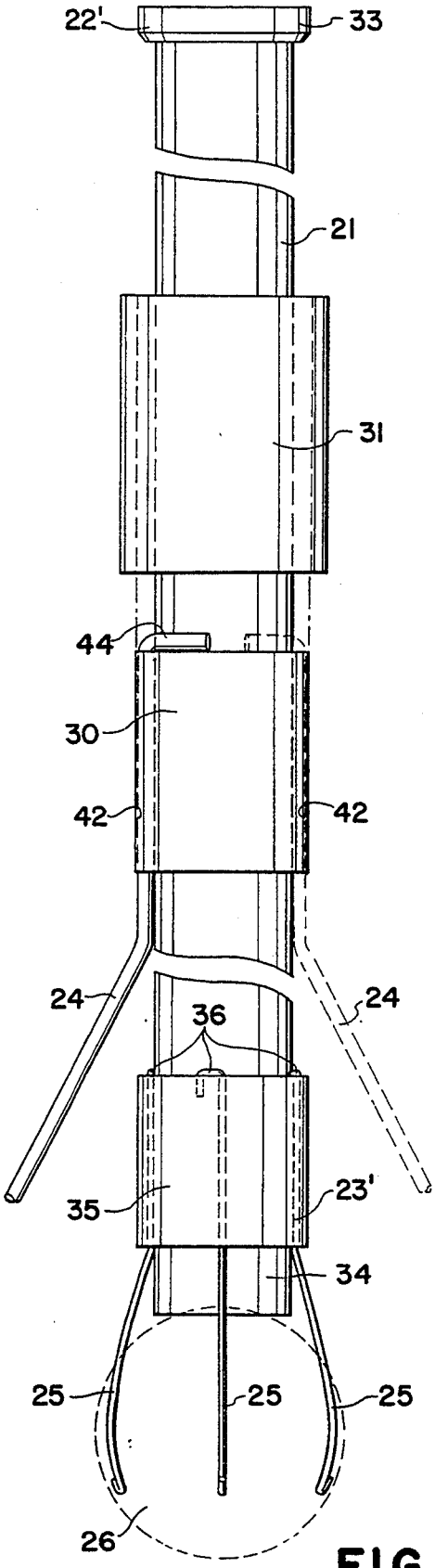
FIG 5
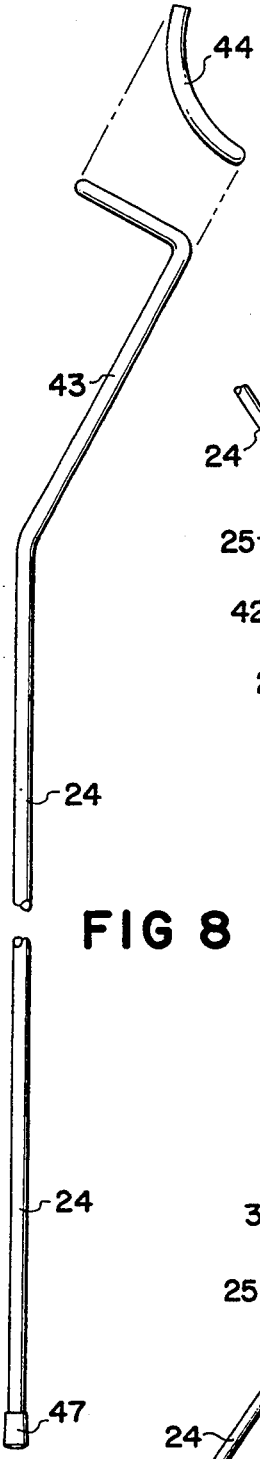
FIG 10
FIG 8
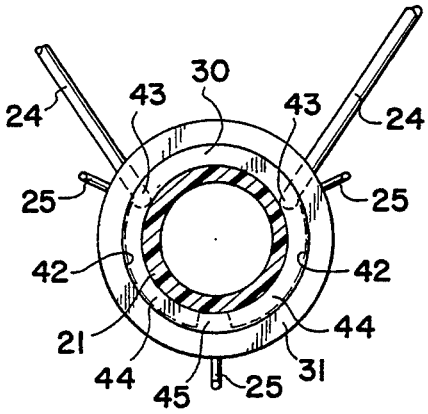
FIG 9
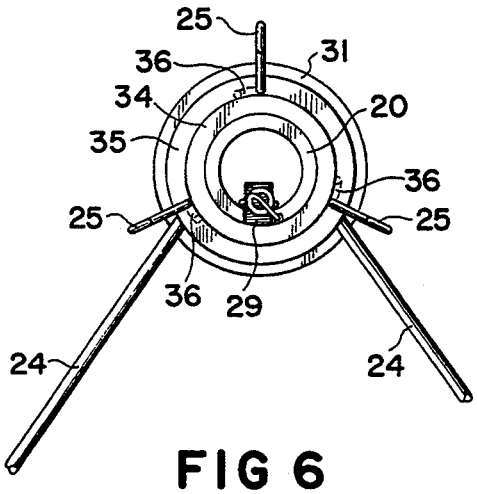
FIG 6

GOLF BALL RETRIEVER AND DISPENSER

BACKGROUND OF THE INVENTION

Golf practice ranges are well known throughout much of the world. A user normally pays a fee for a supply of golf balls, e.g., 25–100, and is provided with a teeing location from which the user hits the balls into a large target area. The balls are struck one at a time with a golf club, taking perhaps 15–30 minutes to hit 25–100 balls into the target area. Some persons have physical impairments that prevent them from bending to pick up a ball from the ground and place it on a tee from which the ball is struck by a golf club. There are no known devices available on the market to allow one to accomplish this task without bending the back.

It is an object of this invention to provide a novel apparatus for picking up a golf ball and placing it on a tee. It is another object of this invention to provide such an apparatus which will permit the golfer to accomplish this without enduring any back stresses. Still other objects will become apparent from the more detailed description which follows.

BRIEF SUMMARY OF THE INVENTION

This invention relates to a golf ball retrieving and dispensing apparatus which includes an elongated inner tube and an elongated outer tube mounted telescopically slidable with respect to each other such that a single longitudinal axis is common to both tubes, the tubes being substantially coextensive and having upper and lower ends. The outer tube has two legs releasably attached thereto adjacent its lower end and adapted to hold said apparatus in a general vertical free-standing position when resting on a horizontal surface. The outer tube at its bottom end includes an expandable contractable means to expand sufficiently to encircle a golf ball and then contract sufficiently to grip the golf ball and hold it against the bottom end of the inner tube when the bottom end of the inner tube is retracted to the bottom end of the outer tube and then to expand again and release the golf ball when the bottom end of the inner tube is protracted outwardly from the bottom end of the outer tube.

In special and preferred embodiments of the invention there is a spring positioned in a slot in the lower end of the inner tube and biased so as to maintain the inner tube, when at rest, retracted substantially inside the outer tube but with its lower end exposed outwardly thereof. In another preferred embodiment the means for gripping a golf ball is a combination of three equally spaced spring wire fingers extending downwardly from the lower end of the outer tube. In a further preferred embodiment a resilient cup member releasably grips a golf ball and the inner tube forcibly dispenses same therefrom. In still another preferred embodiment the legs are wire and are bent to fit into grooves in an enlarged portion on the outside of the outer tube, and those bent portions of the wire legs are held in place in the enlarged portion by a hollow cylindrical cover which slides snugly over the enlarged portion. In yet another preferred embodiment the inner tube is prevented from sliding too far out the lower end of the outer tube by having a cap around its upper end which functions as a stop when contacting the upper end of the outer tube. The bottom end of the inner end includes a collar which functions as a stop for the inner tube to maintain that inner tube end exposed outwardly of the outer tube.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

FIG. 5 is an enlarged side elevational view of the outer tube and the lower portion of the inner tube of the apparatus of this invention;

FIG. 6 is a bottom plan view of FIG. 5;

FIG. 8 is a side elevational view of a leg of the apparatus of this invention;

FIG. 9 is a cross-sectional view taken at 9—9 of FIG. 1;

FIG. 10 is a top plan view of the leg of FIG. 8 taken in the direction shown;

DETAILED DESCRIPTION OF THE INVENTION

The novel and inventive features of the apparatus of this invention are best appreciated by reference to the attached drawings.

Figure 2:
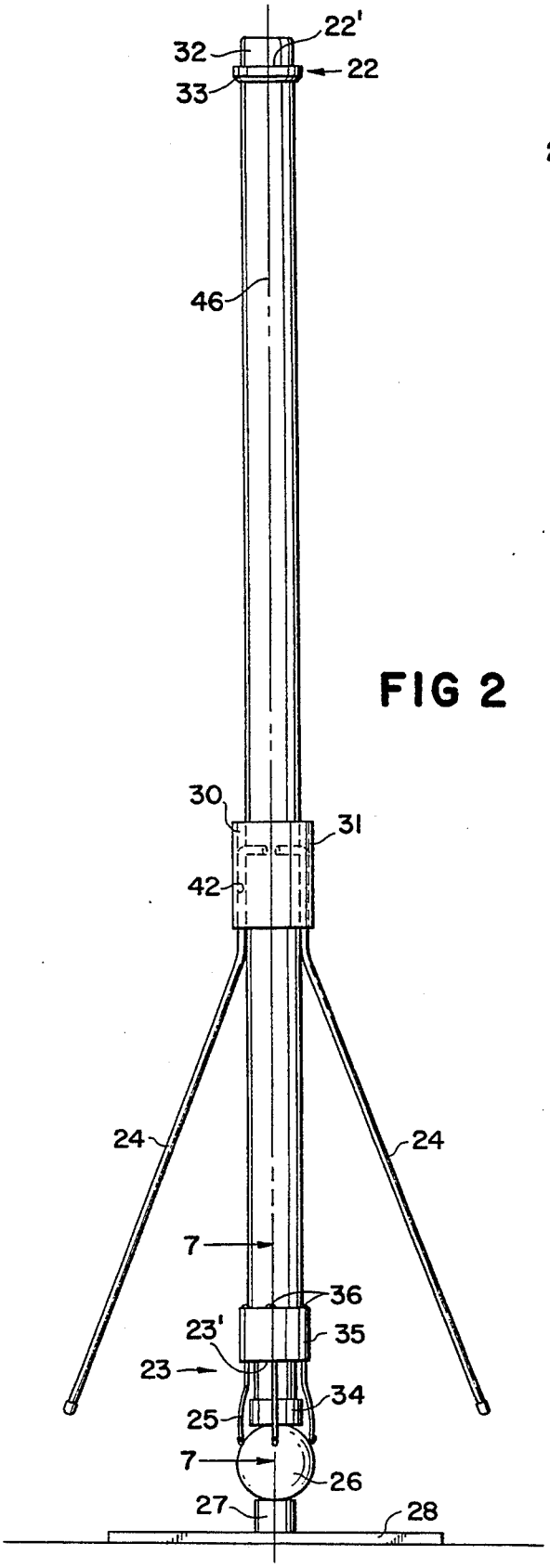
FIG. 2 is a front elevational view of the apparatus shown in FIG. 1.
Figure 1:
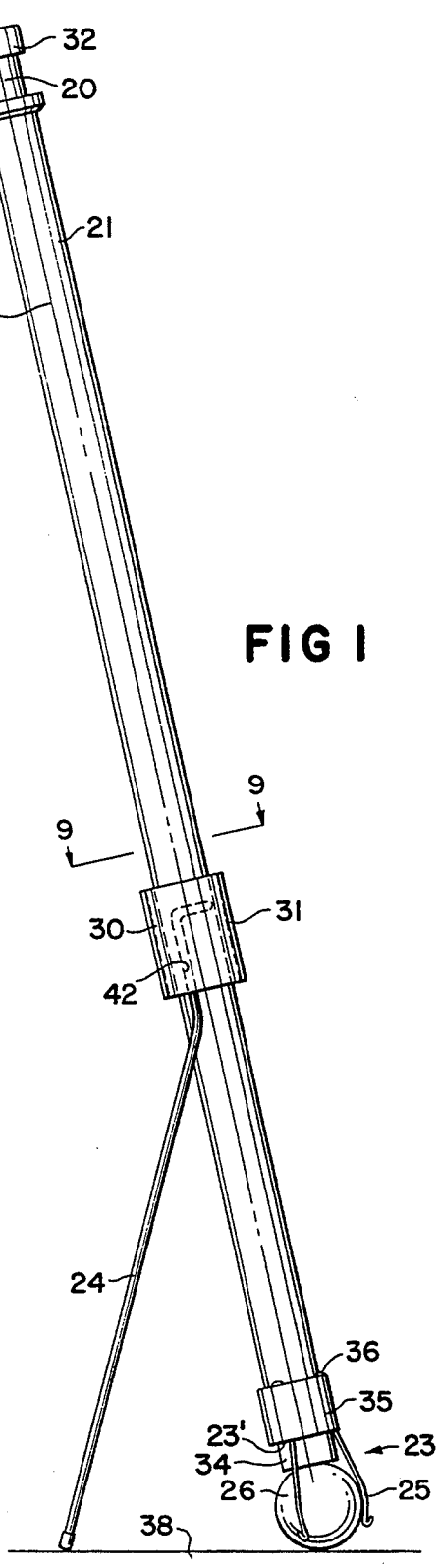
FIG. 1 is a side elevational view of the golf ball retrieving and dispensing apparatus of this invention.

The general nature and utility of this invention may be understood by reference to FIGS. 1 and 2. This apparatus is especially useful for one hitting golf balls from a practice tee where 25–50 golf balls will be hit, one-by-one, from a tee (which elevates the ball above ground level about one-half to one inch) over a relatively short time, e.g. , about 15 minutes. The apparatus is used to pick up a golf ball from the ground as shown in FIG. 1, and place it on a tee as shown in FIG. 2.

The apparatus comprises two telescopically slidable tubular members in the form of tubes or pipes 20 and 21. Inside tube 20 fits loosely, but not wobbly, inside of outside tube 21 such that there is a common longitudinal axis 46 for both tubes 20 and 21. Tubes 20 and 21 are shown to be round in cross-section, but may be square, triangular or other regular shape. Tubes 20 and 21 are generally coextensive, i.e. they have generally the same length between their respective ends but inside tube 20 is made longer so that its upper end 22 and its lower end 23 extend outwardly of respective ends 22' and 23' of outside tube 21. The total length is that which is convenient for a person to use, and, therefore, may vary depending on the height of the person, although generally the overall length will be about 28–36 inches. The tubes 20 and 21 may be made of any convenient material, although plastic or metal are preferred. PVC pipe material is an especially convenient material from which this apparatus may be constructed. At lower end 23' of outer pipe 21 there is a golf ball gripping means, shown here as a combination of three equally spaced wire fingers 25 bent to conform to the spherical shape of a golf ball and made from spring wire so that each finger 25 can expand outwardly, and when at rest, will contract inwardly in a radial direction to engage the golf ball. It is easily understood, therefore, that by pressing the wire fingers 25 downwardly over a golf ball 26 resting on the ground, the fingers 25 will spread outwardly to slide over the golf ball 26 and then contract around the golf ball 26 allowing the golf ball 26 to be picked up while it is being held by the fingers against the lower end 23 of inner tube 20. A collar 35 is shown around lower end 23' of outer tube 21 which holds fingers 25 in position and also serves as a seat against which the collar stop 34 of inner tube 20 rests. The apparatus can then be moved around or rested on its legs 24 (as in FIG. 1) and the ball 26 will remain in the grip of fingers 25. In use it is preferable after dispensing a ball, to regrip another ball with fingers 25 before resting on legs 24 so that it supports the apparatus (with legs 24) thereby protecting fingers 25 from engagement with the ground or the like.

Inner tube 20 in the position shown in FIG. 1 has its lower end 23 outwardly of the lower end 23' of outer tube 21. When it is desired to dispense a golf ball 26 onto a tee 27 as shown in FIG. 2, inner tube 20 is pushed downwardly and slid longitudinally so as to protract its lower end 23 further outside of outer tube 21 and push the golf ball 26 out of the grip of fingers 25. This is accomplished by pushing downward on the cap 32 of upper end 22 of inner tube 20. The tee 27 is shown to be a short rubber tube set into a mat 28 as is typically used at public golf practice tees. The ball 26 in FIG. 2 can be placed, instead, on the familiar wooden tee, if desired.

A spring means 29 is provided internally of outer tube 21 which connects tube 20 to tube 21 and is biased to automatically and sufficiently retract lower end 23 of inner tube 20 inwardly of outer tube 21 when no pressure is applied to further protract inner tube 20 through fingers 25 to release a golf ball 26 therefrom. In order to prevent inner tube 20 from being protracted too far out lower end 23 of outer tube 21 there is a cap 32 attached to upper end 22 of inner tube 20. This functions as a stop means to prevent further downward movement of inner tube 20 with respect to outer tube 21. Collar 33 is shown on outer tube 21 to provide a cooperating surface for cap 32. It is not essential to include collar 33, but it does provide a convenient finger grip for the person operating the apparatus with a thumb on cap 32. If desired an enlarged knob of a convenient shape may be added to the upper end to fit in the palm of the hand of the user or any other type or shape handle can be used in place of cap 32.

Outer tube 21 has an enlarged portion 30 on the outside of tube 21 and another enlarged portion 35 adjacent the lower end 23' of tube 21, the distance between the two portions 30 and 35 depending on the size and shape of legs 24. Here legs 24 are two in number and are made of heavy wire to form with lower end 23 of inner tube 21 (with golf ball 26 gripped by fingers 25) a tripod to allow the apparatus to stand in generally vertical position, tipped to an angle of about 10°-20° from the vertical. Enlarged portion 30 has a pair of spaced grooves 42 in it to seat the upper extremities of the legs 24. The grooves 42 are longitudinal to receive straight portions 43 therein and curved upper end portions which extend laterally so as to keep legs 24 from twisting or otherwise coming loose when the sleeve cover 31 is slid lengthwise snugly over the outside of enlarged portion 30 after legs 24 are nested in grooves 42, as explained more fully hereinafter. This arrangement locks legs 24 securely at the desired angle and provides stability for the apparatus.

Figure 7:
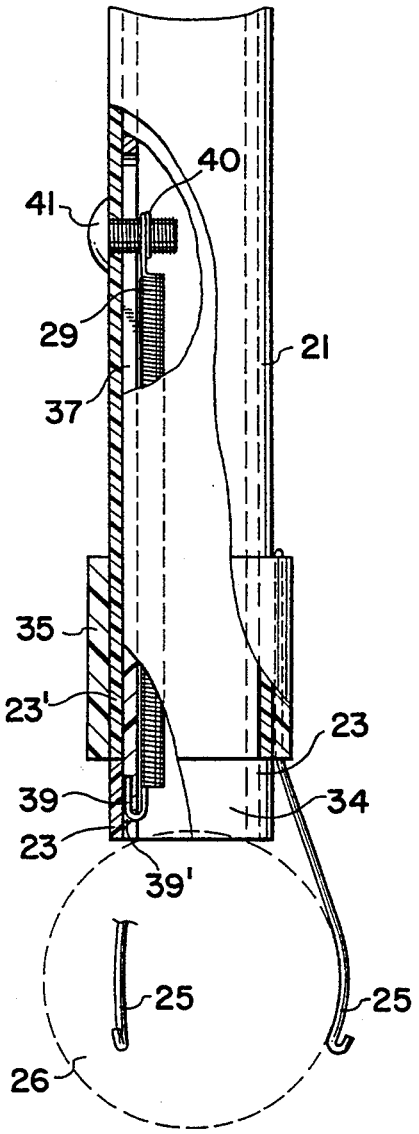
FIG. 7 is an enlarged cross-sectional view taken at 7—7 of FIG. 2.
Figure 4:
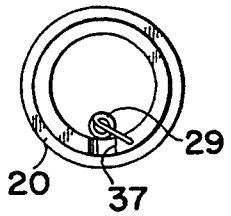
FIG. 4 is a bottom plan view of the inner tube shown in FIG. 3.
Figure 3:
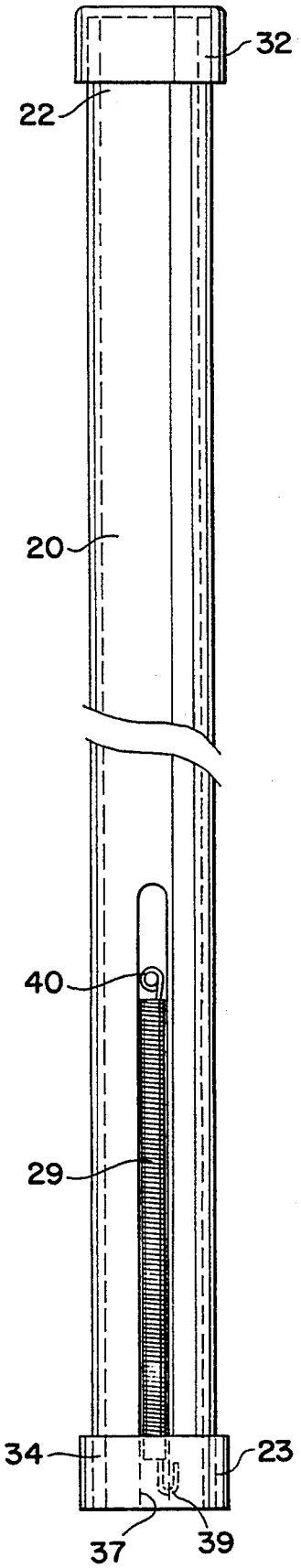
FIG. 3 is a side elevational view of the inner tube of the apparatus of this invention.

FIGS. 3 and 4 show inner tube 20 including lower collar 34, upper collar 32, and spring means 29. Spring means 29 is shown as a long coil spring having a hook 40 at its upper end and a hook connection 39 at its lower end through an opening 39' in tube 20 fixed in place by collar 34. A slot 37 extends upwardly from lower end 23 sufficiently to allow spring to be positioned within the inner tube 20 and slot 37 and thereby to reduce any scraping noise which may be caused by the spring and not to obstruct the sliding movement of inner tube 20 inside of outer tube 21. Hook 40 is attached to outer tube 21 as by screw 41 (see FIG. 7), such that as tube 20 is pushed downwardly so as to protract further out of lower end 23' of outer tube 21 (see FIG. 2) spring 29 will be stretched; and when downward forces on the upper cap 32 of inner tube 20 are released the spring 29 will return to its normal length causing inner tube 20 to retract upwardly into outer tube 21 until collar 34 engages the lower end 23' of outer tube 21. FIG. 7 shows a cross-section along the length of spring 29 and depicts hook 40 as attached to a rivet or screw 41 in the wall of outer tube 21. Spring 29 is generally housed in slot 37 and/or within inner tube 20 and does not interfere with the telescopic movement of inner tube 20 inside of outer tube 21.

Outer tube 21 is shown in FIGS. 5 and 6 including collar 33, enlarged portion 30, sleeve cover 31, lower enlarged portion or collar 35, fingers 25, and anchor portions 36 for holding fingers 25 in place. The upper ends 36 of fingers 25 are bent in a U-shape and are anchored to the collar 35 and/or the outer tube 21 by glue or the like.

Legs 24 are shown in FIGS. 8 and 10 as being heavy wire with an elongated lower straight portion 24, an angled straight portion 43, and a curved portion 44 which partially encircle outer tube 21, as seen in FIG. 9. Caps 47 are shown on the bottom end of legs 24 to prevent legs 24 from sinking into the earth or other soft surfaces upon which the apparatus might rest. The shape and conformation of portions 43 and 44 may be varied as desired in order to be easily attachable and detachable from outer tube 21. In the preferred embodiment shown in the attached drawings, particularly FIGS. 8 and 9, an enlarged portion 30 is positioned on the lower portion of outer tube 21 with spaced and longitudinal grooves 42 to fit leg portions 43. In this instance grooves 42 receive angled portion 43, such grooves being generally parallel to longitudinal axis 46 of outer tube 21. A circumferential ledge 45 is formed around the upper end of enlarged portion 30 to receive curved portion 44 of each leg 24. When portions 43 and 44 of two legs 24 are nested into grooves 42 and engage ledge 45 of enlarged portion 30, sleeve cover 31 is slid over the outside of enlarged portion 30 as shown in FIG. 5. The fit between cover 31 and enlarged portion 30 is snug so that legs 24 are firmly releasably attached to outer tube 21. It is, of course, entirely within the scope of this invention to employ other types of legs, whether permanently attached or detachably connected. The primary advantage to using detachable legs is to allow for easy packaging or storage of this apparatus. The use of two legs 24 permits the legs 24 to be substantially inserted into the hollow of the lower end 23 of inner tube 20 with the curve ends 44 being within the confines of the spaced fingers 25. It may be desirable to have the ends 44 joined so that the legs 24 are unitary in other arrangements.

The materials of construction of the apparatus of this invention may be metal, plastic, or other suitable material. Spring metal wire may be desirably employed for fingers 25, legs 24 and spring 29, whereas PVC, as aforesaid, is preferable for the remainder of the apparatus.

Figure 11:
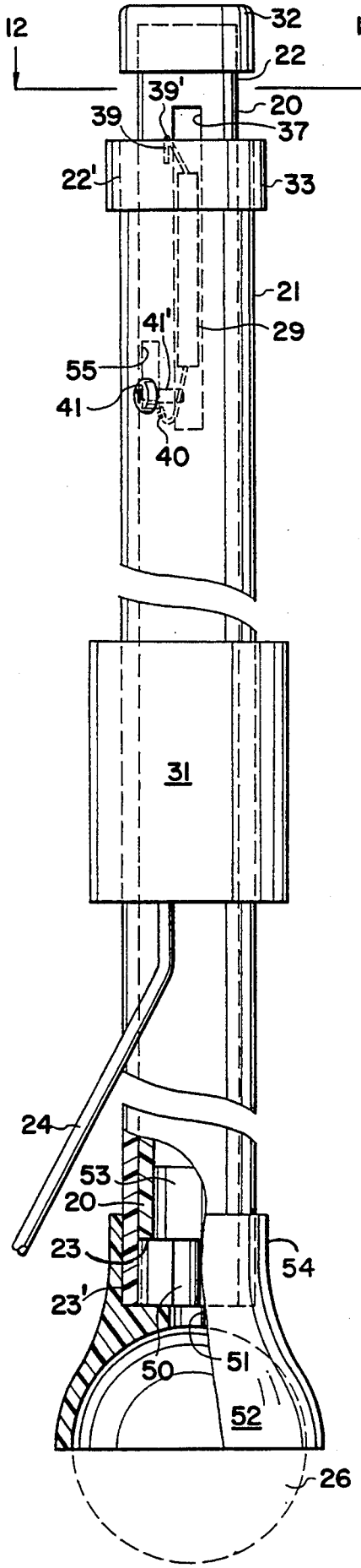
FIG. 11 is an enlarged side elevational view similar to FIG. 5, of another embodiment of this invention.
Figure 12:
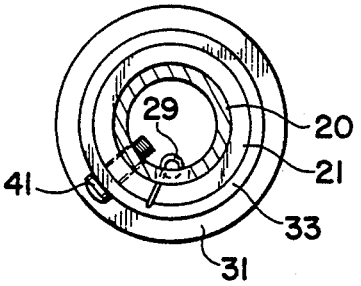
FIG. 12 is a cross-sectional view taken at 12—12 of FIG. 11.
Figure 13:
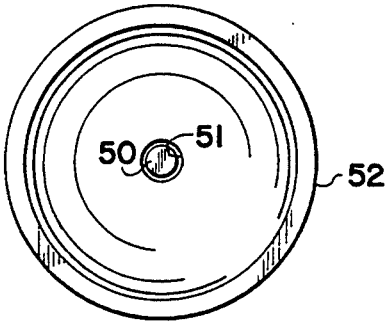
FIG. 13 is a bottom plan view of the resilient cup member and the inner tube ejector centrally thereof.

Another embodiment of the invention is depicted in FIGS. 11–13 where like numerals depict substantially identical elements. The spring 29 has an upper end 39 hooked into an opening 39' passing laterally through inner tube 20. The lower end 40 of spring 29 is connected to outer tube 21 by screw or rivet 41. Slot 37 is provided as set forth in the embodiment shown in FIGS. 1–10. Whether the spring 29 is adjacent the upper ends 22, 22' or lower ends 22, 23' is immaterial. Cap 32 engages the upper end of collar 33 to stop the protraction of the lower end extension pin 50 which extends through opening 51 in resilient cup member 52 attached to the lower end 23' of outer tube 21. Extension pin 50 is attached generally centrally of plug 53 which in turn is affixed to inner tube 20 as by glue or the like. Likewise, cup member 52 includes a sleeve 54 which fits over, and may be secured to, the lower end 23', as by glue or any other appropriate manner, so that it may be replaced when the same has been damaged as by cracking or tearing or the like. Resilient cup member 52 in and of itself is known in the prior art being sold to be attached to the upper end of the handle of a putter so that one may use such cup member to retrieve a golf ball after the same has been putted into the cup of a golf green. The cup member 52 expands when the cup member 52 is forced onto a golf ball 26 and is slightly larger than hemispherical so that the cup member contracts to frictionally grip and retain the golf ball until a releasing force pushes or pulls the golf ball 26 therefrom. This is accomplished herein by pin 50 pushing golf ball 26 out of the grip of cup member 52 by depression of the inner tube 20 by a manual force on cap 32 about one quarter of the diameter of a golf ball whereby tube 20 moves downwardly with respect to outer tube 21 whereby the ball 26 is dispensed from the frictional engagement with cup member 52. The screw 41 has a shank 41' which passes through a slot 55 of a predetermined axial length which not only prevents relative rotation between inner tube 20 and outer tube 21, but acts as stops for the axial protraction of inner tube 20 with respect to outer tube 21. Of course, cap 32 engaging the upper end 22' of outer tube 21 may actually limit the protraction of inner tube 20 rather than screw shank 41' engaging the upper portion of slot 55.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A golf ball retrieving and dispensing apparatus comprising an elongated inner tube and an elongated outer tube mounted telescopically slidable with respect to each other such that a single longitudinal axis is common to both tubes, said tubes being generally coextensive, each tube having an upper end and a lower end, said outer tube having two legs attached thereto adjacent its lower end and adapted to hold said apparatus in a generally vertical free-standing position when resting on a horizontal surface, said outer tube at its bottom end having an expandable contractible means to expand sufficiently to encircle a golf ball and then contract sufficiently to grip a golf ball and hold it against the lower end of said inner tube when said lower end of said inner tube is retracted partially inside said lower end of said outer tube and then to expand again and release a golf ball when said lower end of said inner tube is further protracted outwardly from said lower end of said outer tube, said expandable, contractible means including a plurality of spring fingers extending downwardly from said lower end of said outer tube and adapted to grip an outer surface of a golf ball when said fingers contract from a sprung position inwardly against a golf ball to grip the same.

2. The apparatus of claim 1 further including automatic means to maintain said lower end of said inner tube partially retracted inside the bottom end of said outer tube.

3. The apparatus of claim 2 wherein said automatic means includes coil spring resistant to tension forces thereon and having one end of said spring attached to said outer tube and another end of said spring attached to said inner tube.

4. The apparatus of claim 1 further including stop means to prevent said inner tube from protracting outwardly of said bottom end of said outer tube more than about the diameter of a golf ball.

5. The apparatus of claim 4 wherein said stop means includes a cap on said upper end of said inner tube adapted to engage said upper end of said outer tube.

6. The apparatus of claim 1 further including stop means to prevent said inner tube from completely retracting inwardly of said bottom end of said outer tube.

7. The apparatus of claim 6 wherein said stop means includes a collar on said lower end of said inner tube adapted to engage said lower end of said outer tube.

8. A golf ball retrieving and dispensing apparatus comprising an elongated inner tube and an elongated outer tube mounted telescopically slidable with respect to each other such that a single longitudinal axis is common to both tubes, said tubes being generally coextensive, each tube having an upper end and a lower end, said outer tube having two legs attached thereto adjacent its lower end and adapted to hold said apparatus in a generally vertical free-standing position when resting on a horizontal surface, said outer tube at its bottom end having an expandable contractible means to expand sufficiently to encircle a golf ball and then contract sufficiently to grip a golf ball and hold it against the lower end of said inner tube when said lower end of said inner tube is retracted partially inside said lower end of said outer tube and then to expand again and release a golf ball when said lower end of said inner tube is further protracted outwardly from said lower end of said outer tube, means for detachably connecting said legs to said outer tube, said means for detachably connecting including a raised portion on said outer tube having generally longitudinal spaced grooves for seating a portion of each said leg therein, and a hollow tubular cover slidingly fitted over said raised portion to lock said leg portions in said grooves.

9. The apparatus of claim 8 wherein said expandable, contractible means comprises a resilient cup member adapted to grip an outer surface of a golf ball with said cup member and then to contract inwardly against a golf ball to grip the same.

10. The apparatus of claim 9 wherein said cup member includes an opening generally centrally thereof and aligned with said longitudinal axis, said bottom end of said inner tube including an extension passing through said opening for dispensing a golf ball from said cup member upon movement of said inner tube downwardly with respect to said outer tube.

11. The apparatus of claim 8 wherein each said leg includes a curved upper end adapted to partially encircle said outer tube.

12. A golf ball retrieving and dispensing apparatus comprising an elongated inner tube and an elongated outer tube mounted telescopically slidable with respect to each other such that a single longitudinal axis is common to both tubes, said tubes being generally coextensive, each tube having an upper end and a lower end, said outer tube at its bottom end having an expandable contractible means to expand sufficiently to encircle a golf ball and then contract sufficiently to grip a golf ball and position it adjacent the lower end of said inner tube when said lower end of said inner tube is retracted partially inside said lower end of said outer tube and then to expand again and release a golf ball when said lower end of said inner tube is further protracted outwardly from said lower end of said outer tube, automatic means for maintaining said lower end of said inner tube partially retracted inside the bottom end of said outer tube and for simultaneously extending the upper end of said inner tube outwardly of said upper end of said outer tube, said automatic means including a coil spring between said outer tube and said inner tube biasing said upper end of said inner tube outwardly, a pair of spaced elongated legs having upper end portions detachably connected to said outer tube and having free ends adapted to engage a horizontal surface to maintain said apparatus in a generally vertical free-standing position on a horizontal surface, and a hollow tubular cover slidingly fitted over said upper end portions to lock said legs to said outer tube.

13. The apparatus of claim 12 wherein said expandable, contractible means comprises a resilient cup member adapted to grip an outer surface of a golf ball with said cup member and then to contract inwardly against a golf ball to grip the same.

14. The apparatus of claim 13 wherein said cup member includes an opening generally centrally thereof and aligned with said longitudinal axis, said bottom end of said inner tube including an extension passing through said opening for dispensing a golf ball from said cup member upon movement of said inner tube downwardly with respect to said outer tube.

15. The apparatus of claim 12 further including stop means to prevent said inner tube from protracting outwardly of said bottom end of said outer tube more than about the diameter of a golf ball.

16. The apparatus of claim 15 wherein said stop means includes a cap on said upper end of said inner tube adapted to engage said upper end of said outer tube.

* * * * *